US006017236A

United States Patent [19]

Yoshida et al.

[11] Patent Number: 6,017,236

[45] Date of Patent: Jan. 25, 2000

[54] MECHANISM FOR DETECTING AN UNLOCKED STATE OF CONNECTORS

[75] Inventors: Haruki Yoshida; Masanori Tsuji, both of Shizuoka, Japan

[73] Assignee: Yazaki Corporation, Tokyo, Japan

[21] Appl. No.: 09/086,936

[22] Filed: May 29, 1998

[30] Foreign Application Priority Data

Jun. 4, 1997 [JP] Japan ..... 9-146389

[51] Int. Cl.[7] ..... H01R 4/50

[52] U.S. Cl. ..... 439/347; 439/488; 439/489

[58] Field of Search ..... 439/347, 488, 439/489, 157, 911, 354

[56] References Cited

U.S. PATENT DOCUMENTS

| | | | |
|---|---|---|---|
| 5,263,871 | 11/1993 | Sano | 439/157 |
| 5,800,202 | 9/1998 | Tsuji et al. | 439/347 |

FOREIGN PATENT DOCUMENTS

| | | |
|---|---|---|
| 2-50981 | 4/1990 | Japan . |
| 3-74483 | 7/1991 | Japan . |
| 8-279375 | 10/1996 | Japan . |

*Primary Examiner*—Paula Bradley
*Assistant Examiner*—Tho D. Ta
*Attorney, Agent, or Firm*—Armstrong, Westerman, Hattori, McLeland & Naughton

[57] ABSTRACT

A mechanism for detecting an unlocked state of connectors is provided. An interfering portion for interfering with a slider which is not pushed in is formed on a mating component to which a component having first and second connectors is attached. The locking plate of the slider is provided with an inclined portion and a flat portion in a direction perpendicular to the connector engagement direction. The second connector is provided with an inclined surface corresponding to the inclined portion, a flat surface corresponding to the flat portion, and an insertion opening adjacent to the flat surface for accommodating the locking plate. When the flat portion is completely in contact with the flat surface, the length of the protruding portion of the slider is the same as the width of the clearance between the second connector and the interfering portion. When the inclined portion slides along the inclined surface so that the terminals of the connectors are separated from each other, the length of the protruding portion of the slider is the same as the width of the clearance. A side surface of the interfering portion faces to the operation surface of the pushed-in slider.

7 Claims, 16 Drawing Sheets

MECHANISM FOR DETECTING AN UNLOCKED STATE OF CONNECTORS

BACKGROUND OF THE INVENTION

1. Field of the Invention

The present invention relates to a mechanism for detecting an unlocked state of connectors in a structure in which a connector having a lock slider is engaged with a mating connector, and the slider is pushed in so that the connectors are locked.

2. Related Art

FIGS. 19A and 19B show a connector locking mechanism disclosed in Japanese Utility Model Laid-Open No. 2-50981.

In this mechanism, a lock lever 52 is rotatably provided to a female connector 51, and a male connector 53 is engaged with the female connector 51. The lock lever 52 is then rotated by hand so as to be engaged with the rear of the male connector 53.

The lock lever 52 is supported by the female connector 51 with a pin shaft 54, and energized by a coil spring 55 in the longitudinal direction. The lock lever 52 is provided with a stopper frame 56, and a stopper protrusion 57 for holding the stopper frame 56 is formed inside the male connector 53.

In the case where the lock lever is not rotated, as shown in FIG. 19A, an electrical equipment cover 5 interferes with the tip of the lock lever 52, and cannot be attached to an electric equipment main body 59. Thus, the unlocked state of the connectors can be detected. After the male connector 53 is locked by rotating the lock lever 52, the cover 58 covers the main body 59, as shown in FIG. 19B.

With the above conventional structure, however, there have been a few problems. First of all, after a locking operation, the resiliency of the coil spring 55 works all the time. If left in a high temperature and high humidity over a long period of time, the stopper frame and other parts are deformed and end up unlocking the connectors. Secondly, since the lock lever 5 always stands from the female connector 51, deformation and damage are often caused due to outside pressure. The pin shaft 54 and the coil 55 required in attachment of the lock lever 52 also increase the assembly and production costs.

FIGS. 20A to 20C show a connector structure disclosed in Japanese Utility Model Laid-Open No. 3-74483.

In this structure, a slide lever 62 is slidably provided to a female connector 61 in a direction perpendicular to the connector engagement direction. A male connector 63 is provided with an inclined groove 65 for engaging a protrusion 64 of the slide lever 62, so that the male connector 63 can be pulled into the female connector 61 by pushing the slide lever 62 in.

In the initial engagement state of the male connector 63 and the female connector 61, as shown in FIG. 20B, the slide lever 62 is pushed out. The slide lever 62 is then pushed in, as shown in FIG. 20C, so that the connectors 61 and 63 are engaged.

With the above conventional structure, however, if the slide lever 62 is not pushed in, the connectors 61 and 63 remains unconnected, and the unlocked state will go undetected. Furthermore, since the protrusion 64 is engaged with the inclined groove 65, the locking ability of the slide lever 62 is not high enough to lock the connectors.

SUMMARY OF THE INVENTION

The principal object of the present invention is to provide a mechanism for detecting an unlocked state of connectors which can surely prevent failures in detecting an unlocked state of connectors and improve reliability in locking operations.

To achieve the above object, the mechanism for detecting an unlocked state of connectors of the present invention includes: a first connector; a locking slider provided slidably to the first connector in a direction perpendicular to the connector engagement direction; a second connector to be connected to the first connector; a component having the first and second connectors to be attached to a mating component. This mechanism is characterized in that the mating component is provided with an interfering portion for interfering with the slider when it has not been pushed in.

The locking plate of the slider is provided with a front inclined portion and a rear flat plate in a direction perpendicular to the connector engagement direction. The second connector is provided with a front inclined surface corresponding to the inclined portion, a rear flat surface corresponding to the flat portion, and an insertion opening adjacent to the flat surface for accommodating the locking plate.

When the flat portion and the flat surface is entirely in contact with each other after the slider is pushed in, the length of the protruding portion of the slider may be the same as the width of the clearance between the second connector and the interfering portion. Alternatively, when the terminals of the connectors are separated from each other as the inclined portion slides along the inclined surface, the length of the protruding portion of the slider may be the same as the width of the clearance. It is also effective that the side surface of the interfering portion faces to the operation surface of the pushed-in slider.

In accordance with a first aspect of the present invention, the protruding slider comes into contact with the interfering portion, thereby hindering attachment of the components. Thus, it can be detected that the slider is not pushed in.

In accordance with a second aspect of the present invention, the flat portion in a direction perpendicular to the connector engagement is brought into contact with the flat surface of the second connector, so that the connectors can be surely locked.

In accordance with a third aspect of the present invention, as the securely locked connectors are connected to each other, incomplete push-in of the slider becomes acceptable to some extent.

In accordance with a fourth aspect of the present invention, the inclined portion slides on the inclined surface as the slider pushed in, so that the connectors are separated from each other. Here, the components are attached to each other with no conductivity between the terminals. In this case, there is no risk of spark, and incomplete connector engagement can be detected by a conductivity test in an after-procedure.

In accordance with a fifth aspect of the present invention, the operation surface of the slider is in contact with the side surface of the interfering portion in the locked condition. Thus, the slider is prevented from slipping off, and the locked condition can be maintained.

The above and other objects and features of the present invention will be more apparent from the following description taken in conjunction with the accompanying drawings.

BRIEF DESCRIPTION OF THE DRAWINGS

FIG. 17 is a side view of illustrating a situation where the components are connected when the slider has not been pushed in;

FIG. 18 is a front view illustrating a situation where the components are connected when the slider has not been pushed in;

DETAILED DESCRIPTION OF THE PREFERRED EMBODIMENTS

The following is a detailed description of embodiments in accordance with the present invention, with reference to the accompanying drawings.

FIGS. 1 to 4 show a lock-type connector used in the present invention. The lock-type connector 1 is also disclosed in Japanese Patent Application Laid-Open No. 8-279375 and Japanese Patent Application No. 8-325294 submitted by the present applicant.

A lock slider 3 is slidably disposed in the mid section of a male connector 2 in a direction perpendicular to the connector engagement direction, and a female connector 4 is locked to the male connector 2 by pushing in the slider 3.

Figure 1:
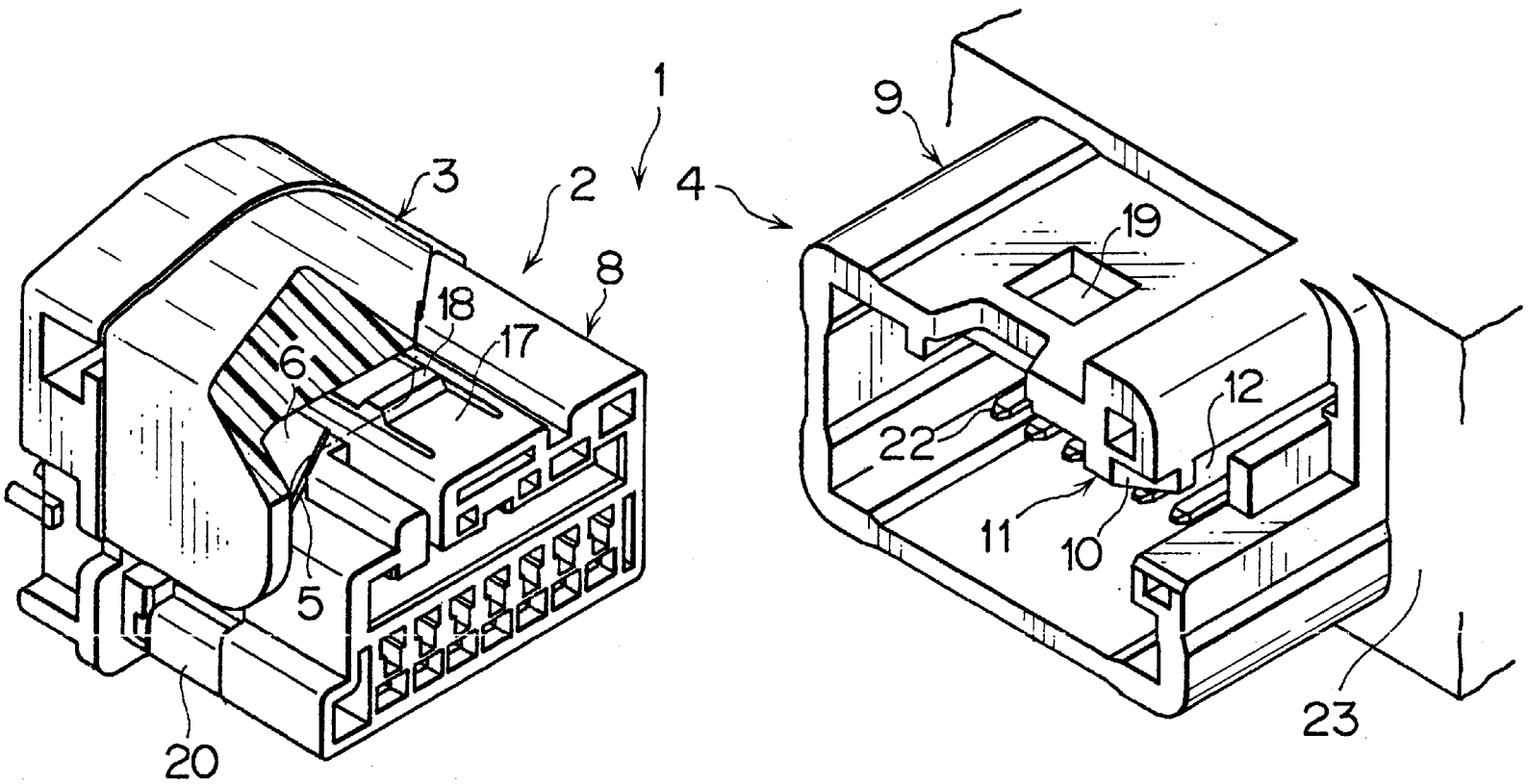
FIG. 1 is an exploded perspective view of lock-type connectors of the present invention.
Figure 2:
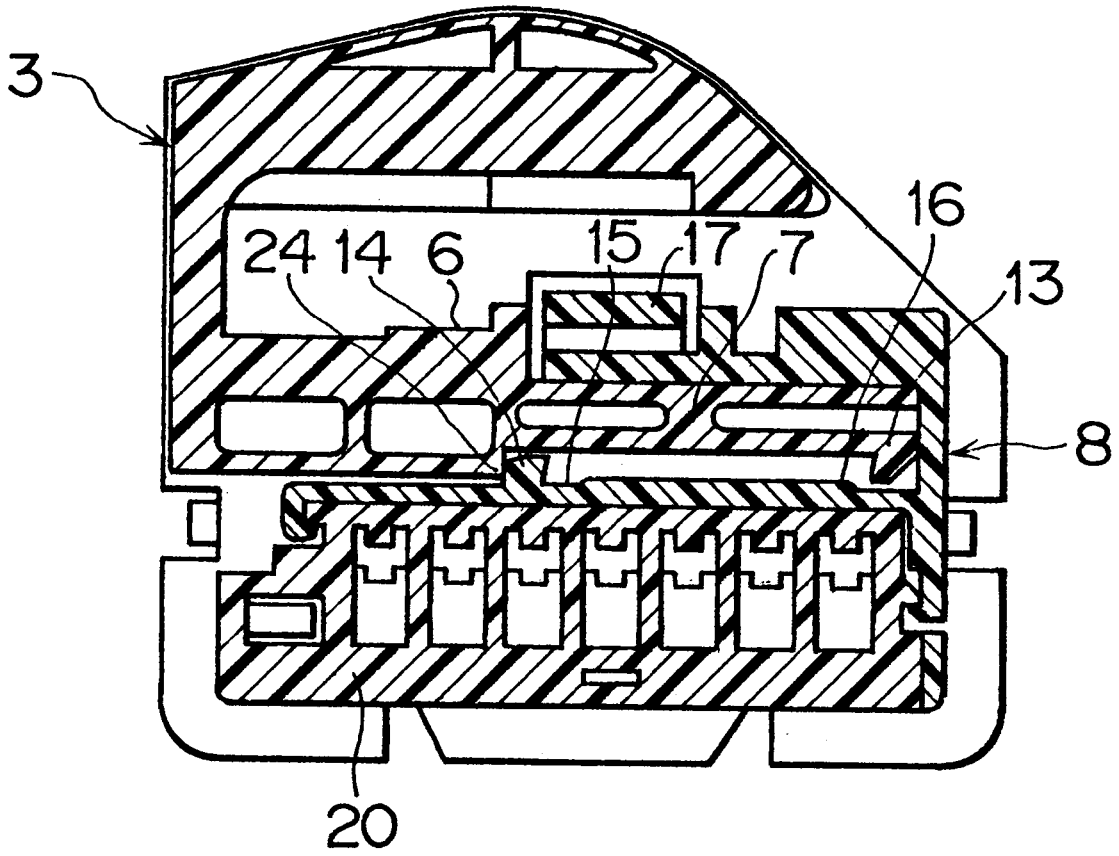
FIG. 2 a vertical sectional view of the male connector having a slider of the present invention.

The slider 3 is made of synthetic resin, and provided with a locking plate 6 (shown in FIG. 1) having a tapered inclined portion 5, and a rectangular guide plate 7 (shown in FIG. 2). A female housing 9 (shown in FIG. 1) has a lock receiving portion 11 protruding therefrom. The lock receiving portion 11 is provided with a slide inclined surface 10 facing the inclined portion 5. An insertion opening 12 for accommodating the locking plate 6 is formed on the back of the lock receiving portion 11.

The guide plate 7 is provided with a flexible stopper claw 13, and a male connector housing 8 is provided with a slip-off preventing protrusion 14 (shown in FIG. 2) corresponding to the flexible stopper claw 13, a temporary engagement groove 15, and a permanent engagement protrusion 16. The male connector housing 8 also has a flexible locking arm 17, and the female connector housing 9 is provided with an engagement hole 19 to be engaged with an arm protrusion 18. The locking plate 6 and the locking arm 17 doubly connect the connectors 2 and 4.

A female terminal (not shown) is disposed inside the male connector housing 8, thereby forming the male connector 2. The female terminal is doubly secured by a separate stopper 20. A male terminal 22 is disposed inside the female connector housing 9. The female connector 4 is directly attached to an electric device or an electrical equipment 23.

As shown in FIG. 1, the slider 3 is forced into the male connector 2 before connector engagement. By doing so, the slider 3 can be separated from the outside, so that deformation and damage can be prevented. Since there is no need for a coil spring and a pin shaft as in a conventional locking lever, the assembly and production costs can be reduced. The slider 3 is forced into the same place before and after the engagement of the connectors 2 and 4. In this case, the guide plate 7 and the stopper claw 13 go beyond the permanent engagement protrusion 16, as shown in FIG. 2, and a step portion 24 in the mid section comes into contact with the protrusion 14.

Figure 3:
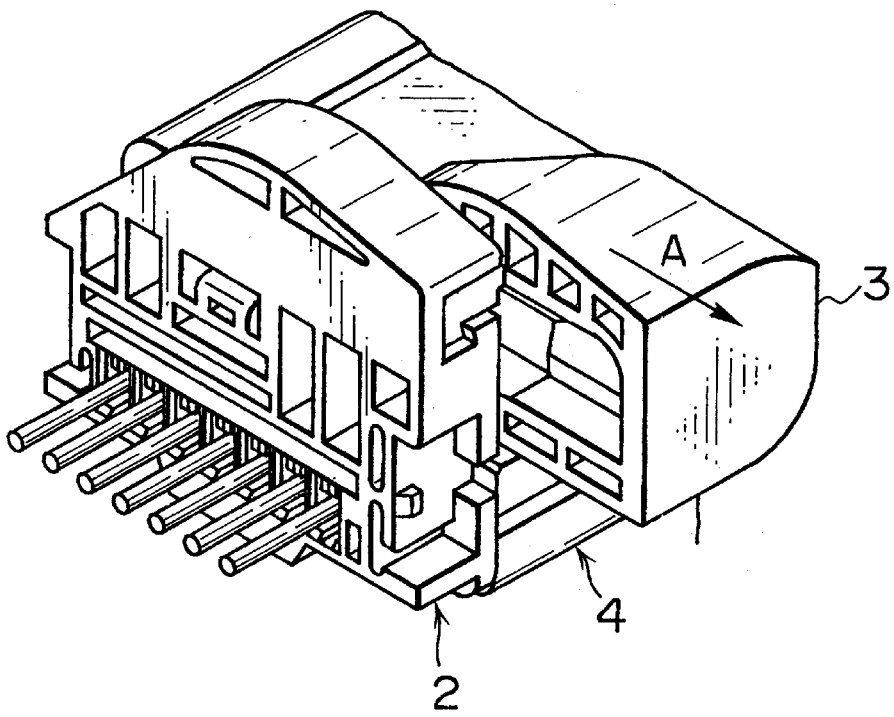
FIG. 3 is a perspective view illustrating how the slider protrudes when the connectors are engaged.

Upon connector engagement, the inclined surface 10 of the female connector 4 is brought into contact with the inclined portion 5 of the locking plate 6, thereby pushing out the slider 3, as indicated by an arrow A in FIG. 3. The stopper claw 13 of the guide plate 7 (shown in FIG. 2) comes into contact with 6 the protrusion 14, so as the slider 3 is brought into a temporarily engaged state.

Figure 4:
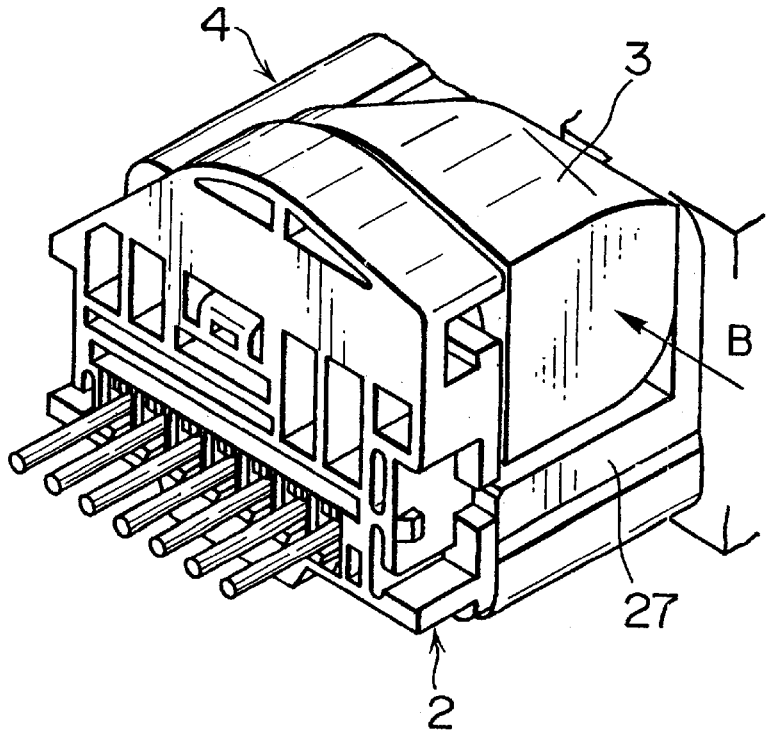
FIG. 4 is a perspective view illustrating how the slider is pushed into the connector after connector engagement.

When the male connector 2 is permanently engaged with the female connector 4, the locking plate 6 is situated above the insertion opening 12 of the female connector 4. As shown in FIG. 4, pushing the slider 3 in the direction of an arrow B locks and secures the female connector 4 to a flat portion 25 (shown in FIG. 5B) on the back of the locking plate 6 (on the back side in the connector engagement direction). An operating portion 26 of the slider 3 is situated substantially on the same plane as a side surface 27 of the female connector 4.

The flat portion 25 extends straight in a direction perpendicular to the connector engagement direction (in the width direction of the connectors), and comes into contact with a flat surface 28 on the back of the lock receiving portion 11. Here, the female connector 4 is locked completely. Unlike the engagement between a conventional inclined cam groove and a protrusion, the locking performance can be dramatically improved by virtue of the contact between the flat portion 25 extending in the direction perpendicular to the connector engagement direction and the flat surface 28.

Figure 5A:
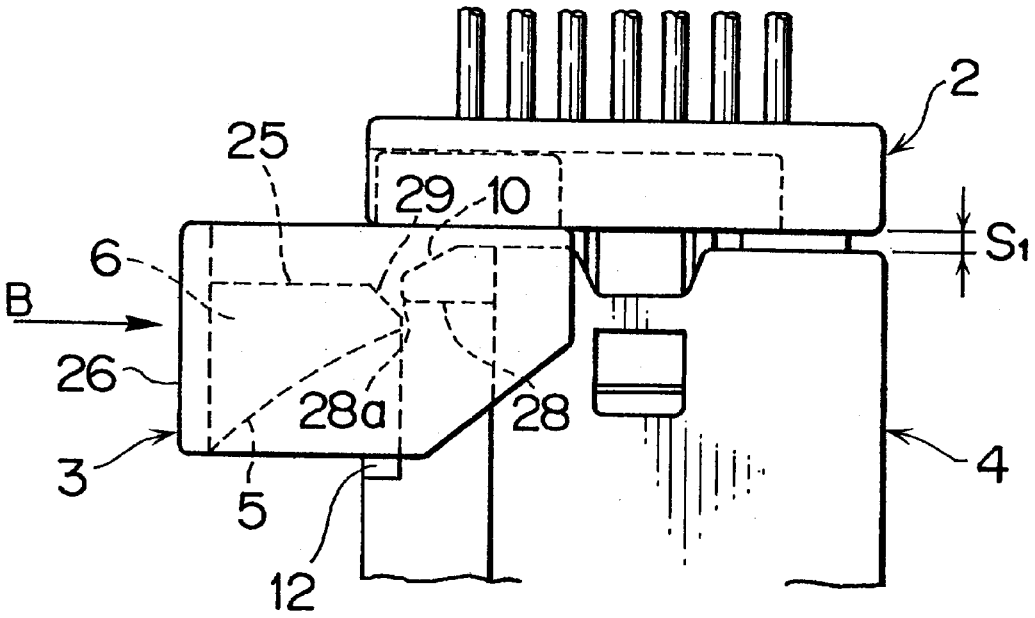
FIGS. 5A and 5B are plan views illustrating a situation where the slider is not pushed in strongly enough.
Figure 5B:
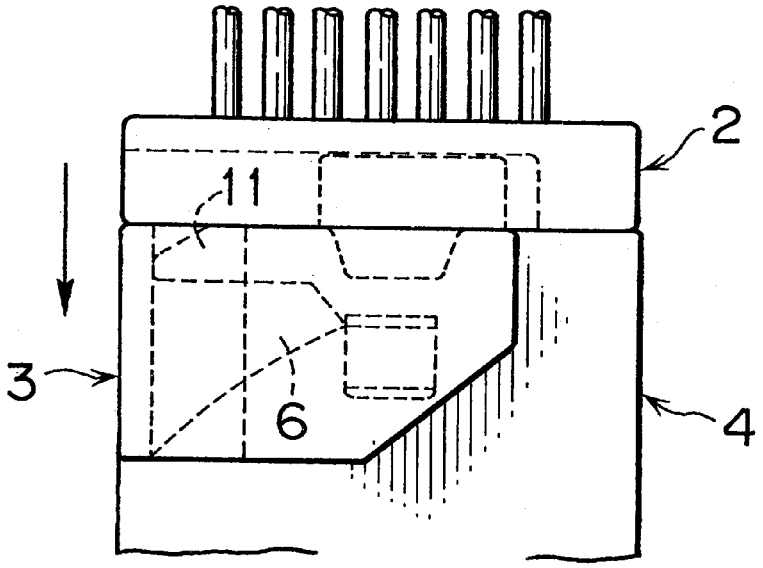

In the case where the engagement between the connectors 2 and 4 are incomplete as shown in FIG. 5A (i.e., the case where a narrow clearance $S_1$ remains between the connectors 2 and 4), the slider 3 is pushed in, so that a reverse inclined portion 29 at the edge of the locking plate 6 slides along a side edge 28*a* of the flat surface 28. Thus, the engagement between the connectors 2 and 4 becomes complete, as shown in FIG. 5B.

Figure 6A:
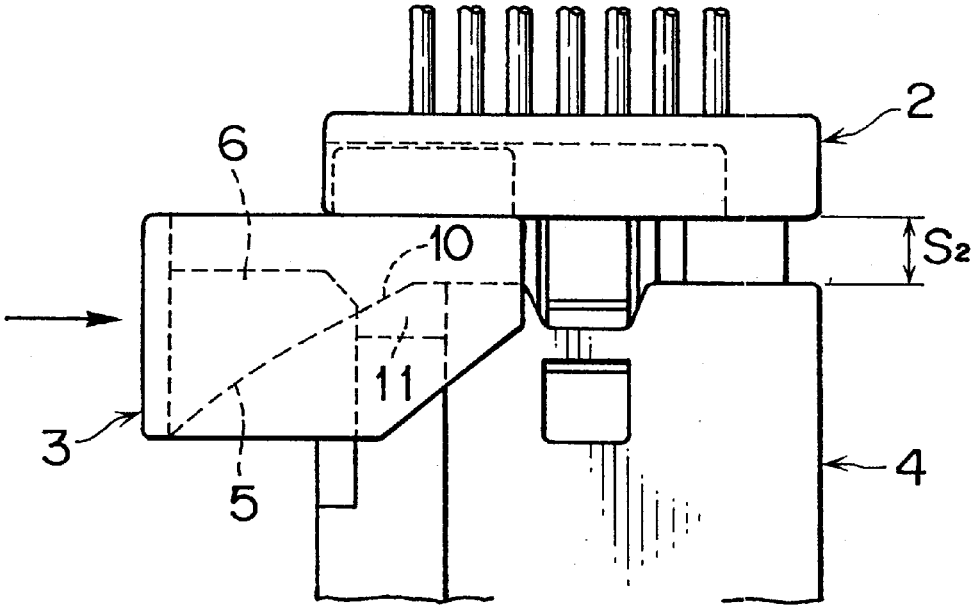
FIGS. 6A and 6B are plan views illustrating a situation where the slider is pushed in only too weakly.
Figure 6B:
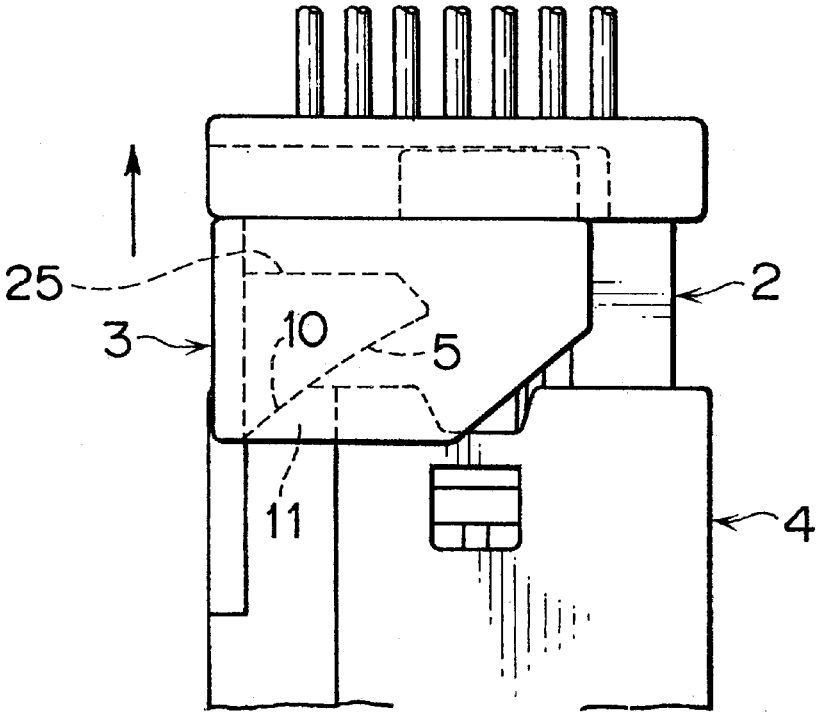
Figure 7A:
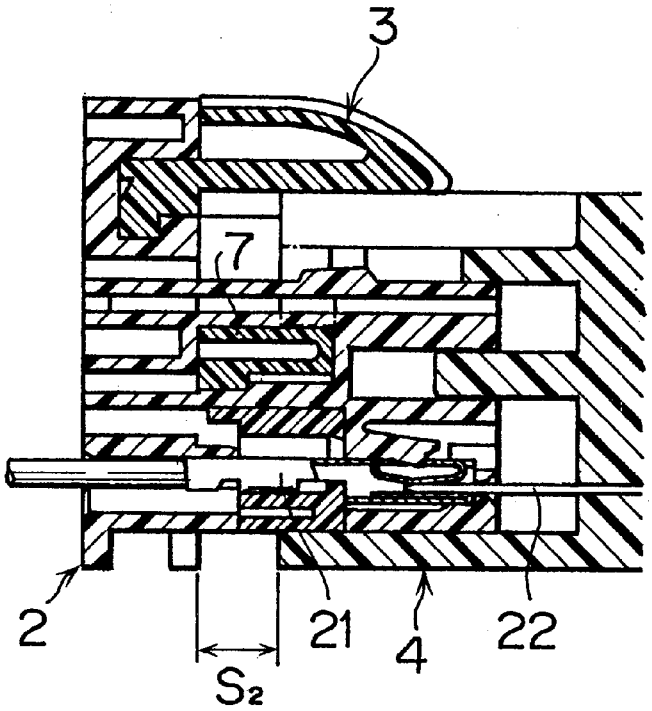
FIGS. 7A and 7B are vertical sectional views illustrating a situation where the connectors corresponding to FIGS. 6A and 6B are not completely engaged.
Figure 7B:
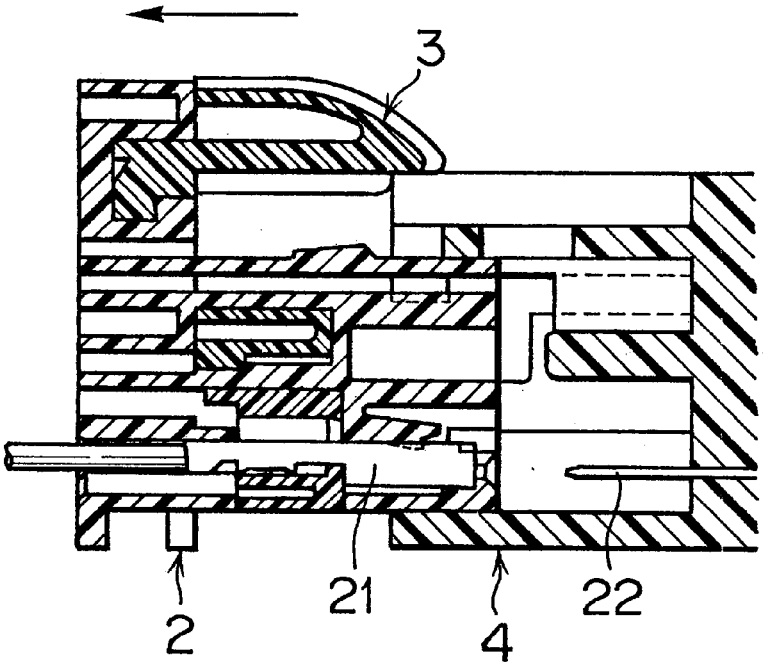

In the case where the engagement between the connectors 2 and 4 with a rather wide clearance $S_2$ is incomplete, and where the male and female terminals 22 and 21 are in contact with each other as shown in FIGS. 6A and 7A, the slider 3 is pushed in so that the inclined portion 5 slides along the inclined surface 10, and that the terminals 22 and 21 are separated from each other as shown in FIGS. 6B and 7B, thereby pushing the connector 2 back to a nonconductive position. Thus, spark upon terminal contact can be prevented, and the incomplete engagement between the connectors 2 and 4 can be detected by a conductivity check in a post procedure.

Figure 8:
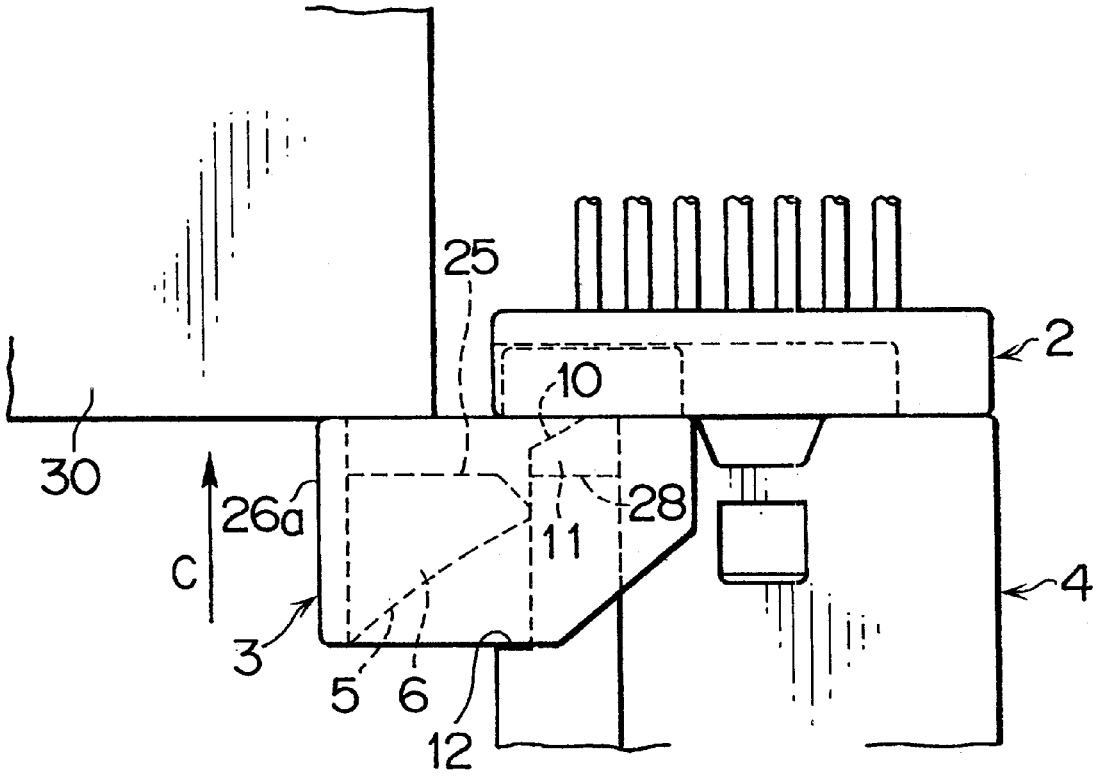
FIG. 8 is a schematic plan view of an unlocked connector detection mechanism of the present invention.

FIG. 8 shows a schematic mechanism for detecting unlocked connectors in accordance with the present invention. If the slider 3 is not pushed in after the connectors 2 and 4 have been completely engaged with each other, the slider 3 is brought into contact with an interfering portion 30 of a mating electrical equipment (not shown) at the time of attachment of an electrical equipment (not shown) on the side of the female connector 4 to the mating electrical equipment as indicated by an arrow C. Thus, that the slider 3 has not been pushed in can be detected. This detecting ability is attributed to the interfering portion 30 provided to the mating electrical equipment for interfering with the protruding slider 3.

In the case where the engagement between the connectors 2 and 4 is complete, i.e., the terminals 21 and 22 are connected completely, and where the push-in of the slider 3 is not complete with the base end (operating portion) 26 of the slider slightly protruding, the slider 3 is not brought into contact with the interfering portion 30, enabling the attachment of the electrical equipment. Here, the flat portion 25 of the locking plate 6 is totally in contact with the flat surface 28 of the lock receiving portion 11, and the locking is complete. The protrusion 18 of the locking arm 17 is also engaged with the engagement hole 19.

In other words, the largest possible clearance $L_1$ between the interfering portion 30 and the female connector 4 is the same as the length of the protruding portion of the slider 3 which is pushed in until locking is done when the connectors 2 and 4 are completely engaged. Within the clearance $L_1$, the flat portion 25 is brought into contact with the flat surface 28, and the operation surface 26a of the slider 3 attached to en electrical equipment is in contact with the side surface 31 of the interfering portion 30, so that the slider 3 is prevented from slipping off. Thus, even if the slider 3 is not engaged (even if the stopper claw 13 is not engaged with the stopper protrusion 16), there should be no problem in practical use.

Figure 9:
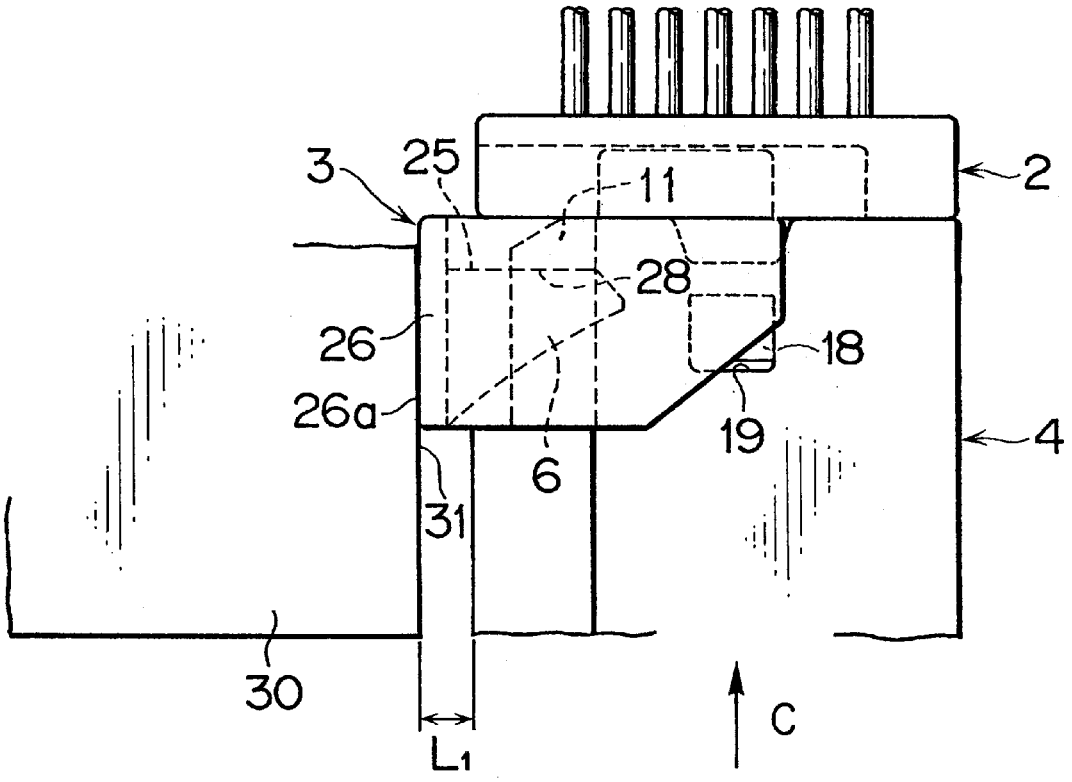
FIG. 9 is a plan view illustrating a situation where incomplete push-in of the slider is not detected when the connectors are completely engaged.
Figure 10:
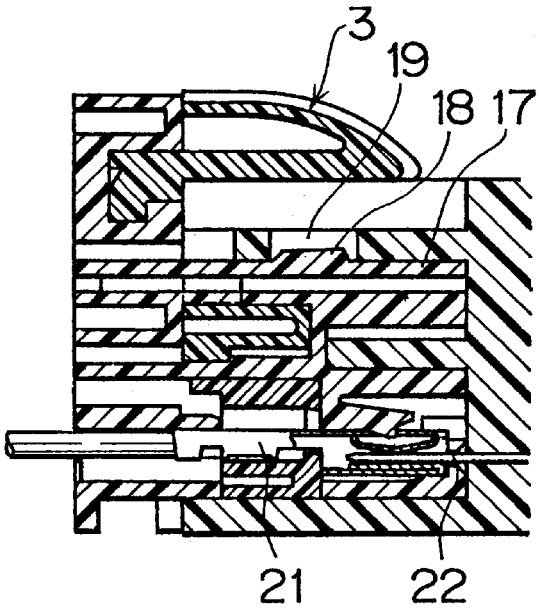
FIG. 10 is a vertical sectional view illustrating the complete engagement of the connectors.
Figure 11:
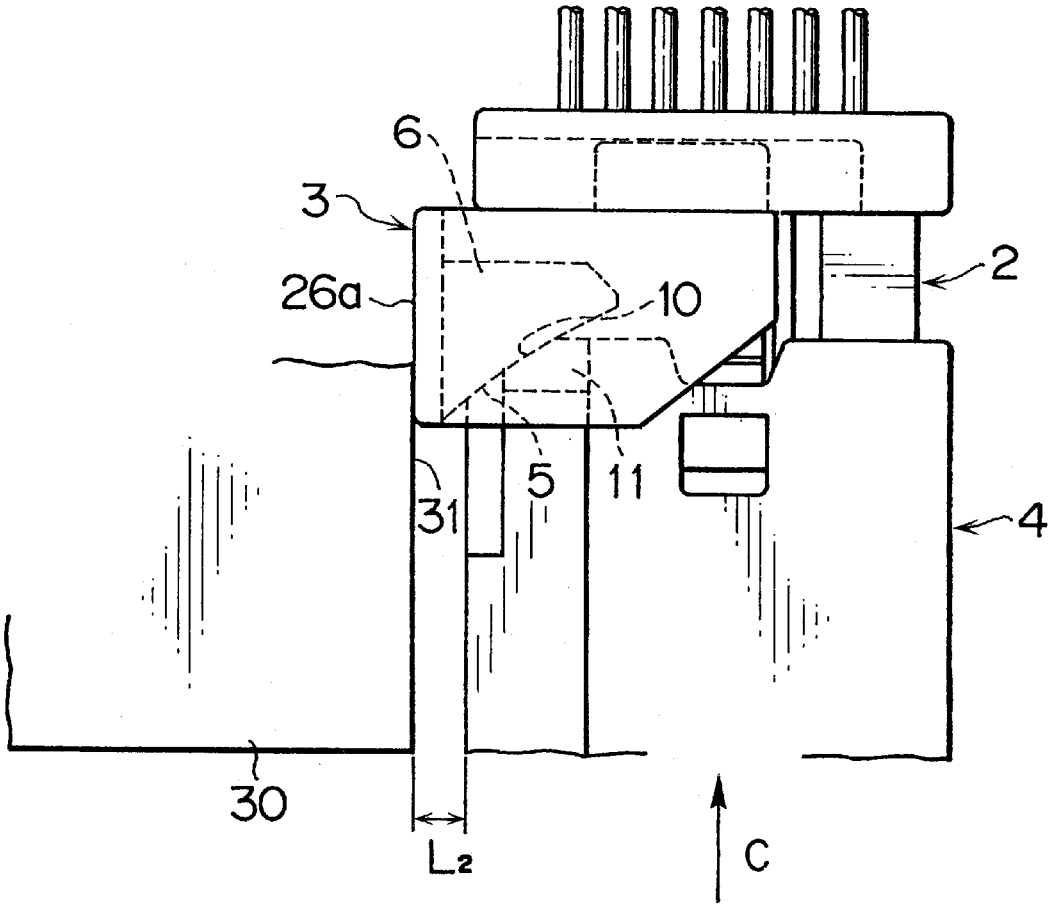
FIG. 11 is a plan view illustrating a situation where a nonconductive state of the connectors is not detected.
Figure 12:
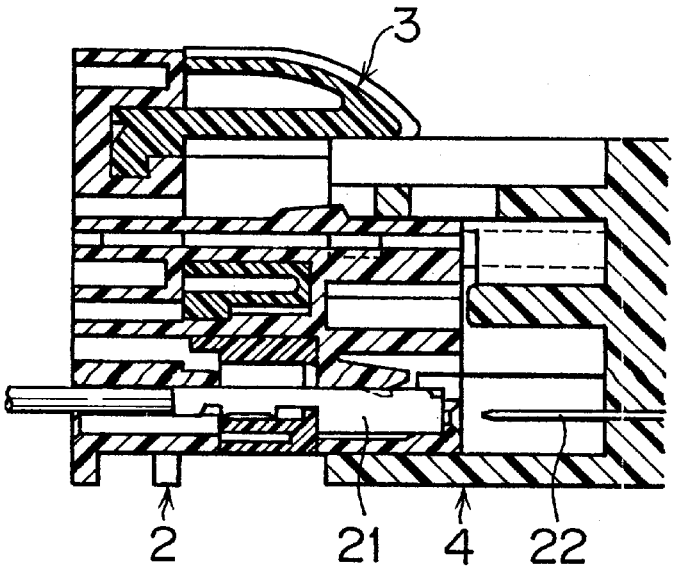
FIG. 12 is a vertical sectional view illustrating the situation where the nonconductive state of the connectors is not detected.

The clearance $L_1$ of FIG. 9 is the same as the clearance $L_2$ of FIG. 11. Although the slider 3 is not completely inserted in FIG. 11, the inclined portion 5 of the locking plate 6 slides along the inclined surface 10 of the lock receiving portion 11, so that the male connector 2 is moved and disconnected from the female connector 4. As shown in FIG. 12, the terminals 21 and 22 are then completely separated from each other, thereby breaking the conductivity.

There is no risk of spark caused by contact between the terminals 21 and 22, and there is no problem at all as incomplete connector engagement can be detected by checking conductivity in the after-procedure. The width of the clearance $L_2$ between the interfering portion 30 and the female connector 4 is the same as the length of the protruding portion of the slider which is pushed in until the male and female terminals 21 and 22 are completely separate so as to eliminate conductivity.

As shown in FIG. 11, the operation surface 26*a* of the slider 3 is in contact with the side surface 31 of the interfering portion 30, so that the male connector 2 is supported by the interfering portion 30. If the engagement of the male connector 2 with the female connector 4 is attempted in this situation, the slider 3 protrudes and interferes with the interfering portion 30. So, the engagement cannot be carried out, and re-attachment is carried out after a failure in a conductivity check.

Figure 13A:
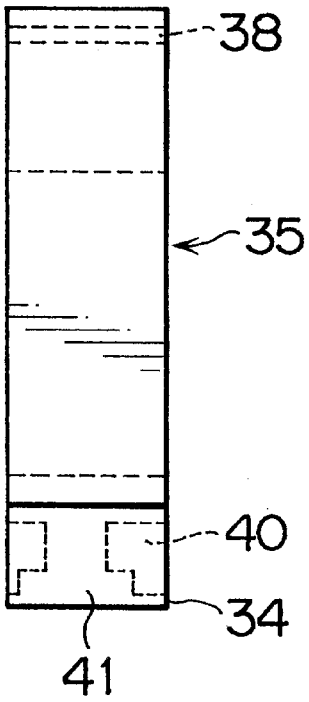
FIG. 13A is a side view of a first component having an interfering portion.
Figure 13B:
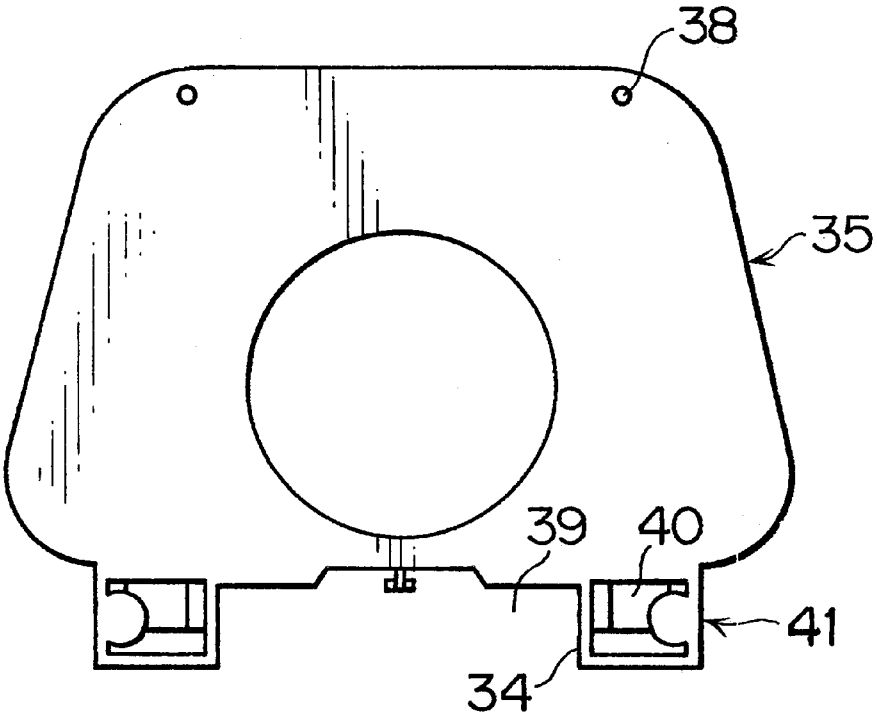
FIG. 13B is a front view of the first component.
Figure 14A:
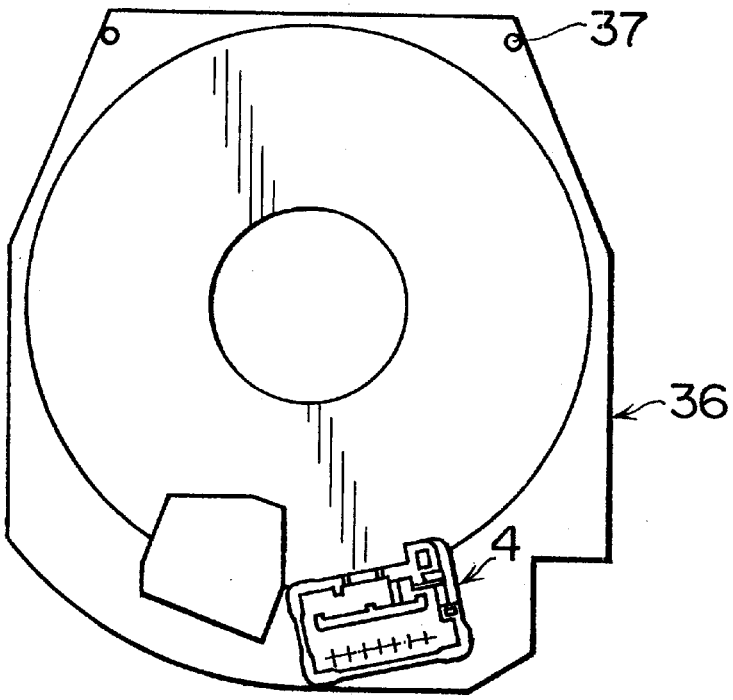
FIG. 14A is a front view of a second component having a female connector.
Figure 14B:
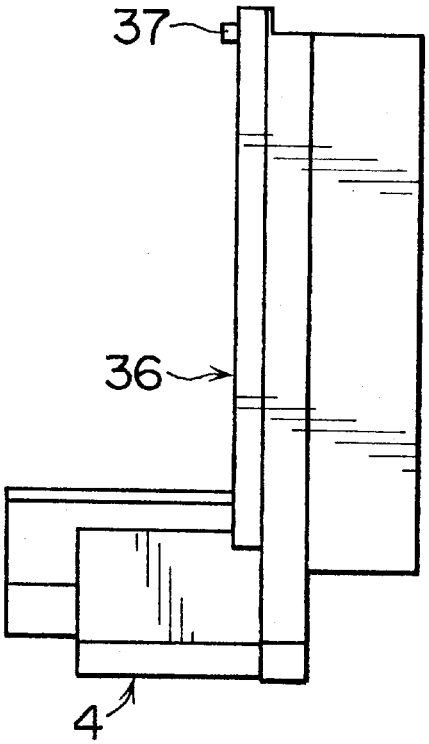
FIG. 14B is a side view of the second component.

FIGS. 13A and 13B show a combination switch 35 as a mating electrical equipment (mating component) having an interfering portion 34. FIGS. 14A and 14B show a spiral 36 as an electrical equipment (component) having the female connector 4. The combination switch 35 and the spiral 36 are used in an air-bag system of a vehicle, for instance.

A pair of positioning pins 37 protrude from the upper part of the spiral 36, and the combination switch 35 is provided with engagement holes 38. The female connector 4 is provided slightly diagonally to the lower portion of the spiral 36. A concave space 39 for receiving the female connector 4 is provided to the lower portion of the combination switch 35. A pair of protrusions 41 each having a hole 40 are situated on both sides of the concave space 39, and a corner inside one of the protrusions 41 serves as the interfering portion 34 for the operating portion 26 of the slider 3.

Figure 15A:
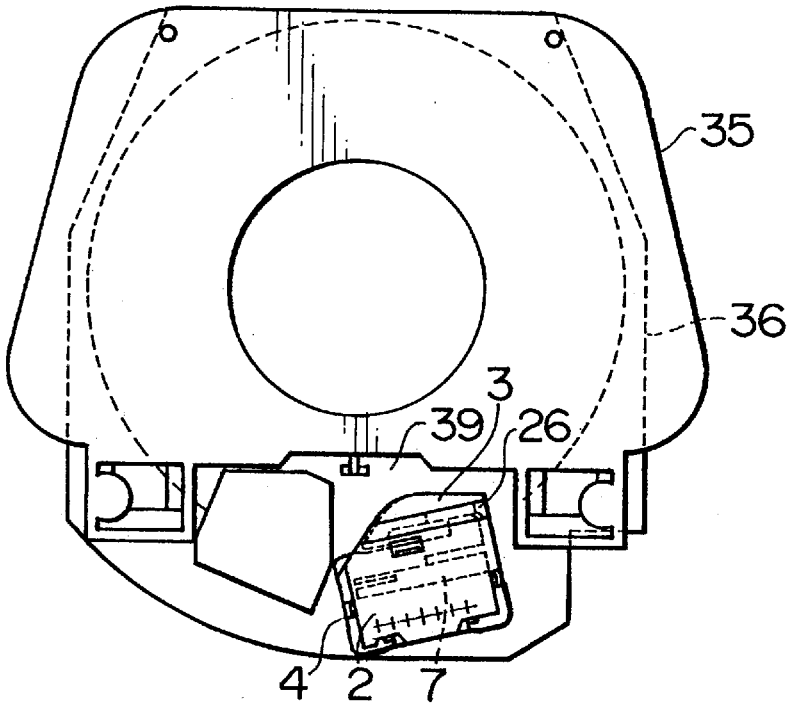
FIG. 15A is a front view illustrating a situation where the second component with the male connector is attached to the first connector.
Figure 15B:
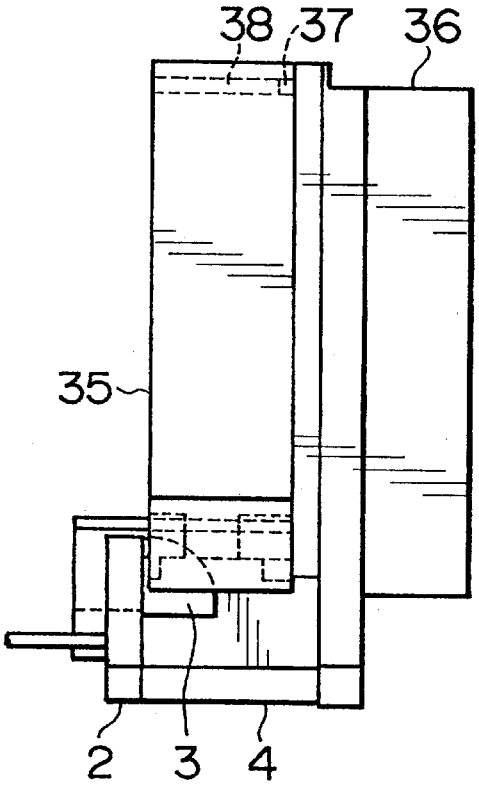
FIG. 15B is a side view of the components of FIG. 15A.

The male connector 2 is engaged with the female connector 4, as shown in FIG. 15, and the slider 3 is pushed into the male connector 2. The spiral 36 is then attached to the combination meter 35 in the engagement direction. The positioning pins 37 are engaged with the engagement holes 38, and the male and female connectors 2 and 4 are situated inside the concave space 39. The interfering portion 34 is situated in the vicinity of the slider 3.

Figure 16A:
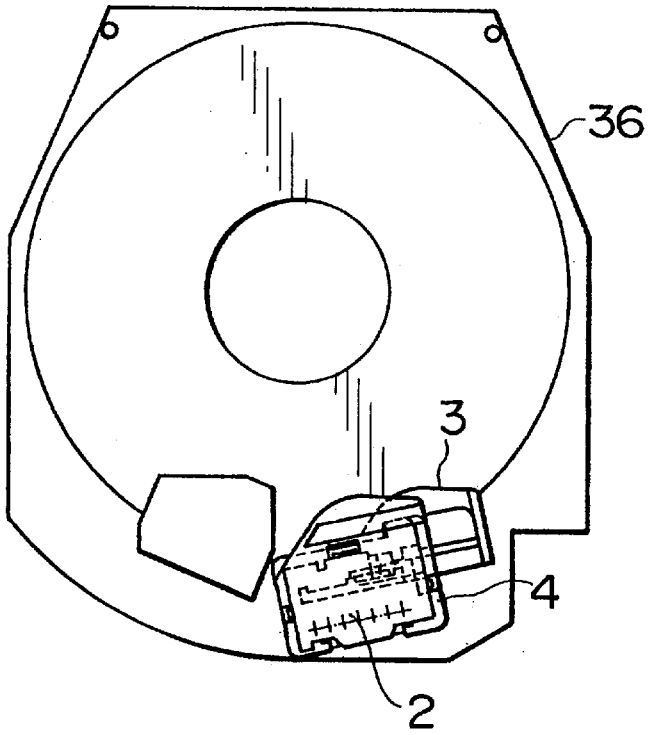
FIG. 16A is a front view of the second component, into which the slider has not been pushed.
Figure 16B:
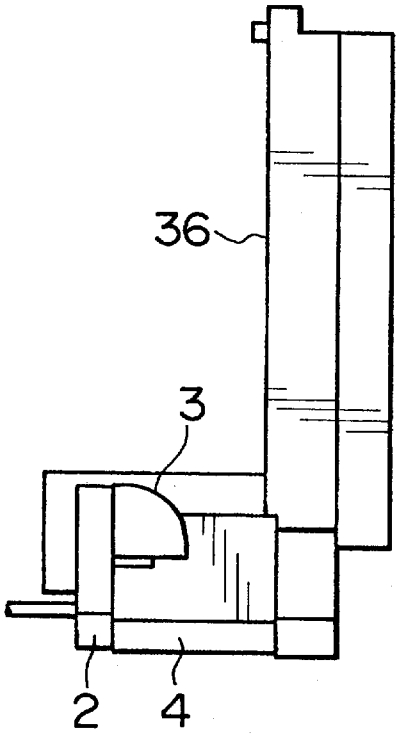
FIG. 16B is a side view of the second component of FIG. 16A.
Figure 17:
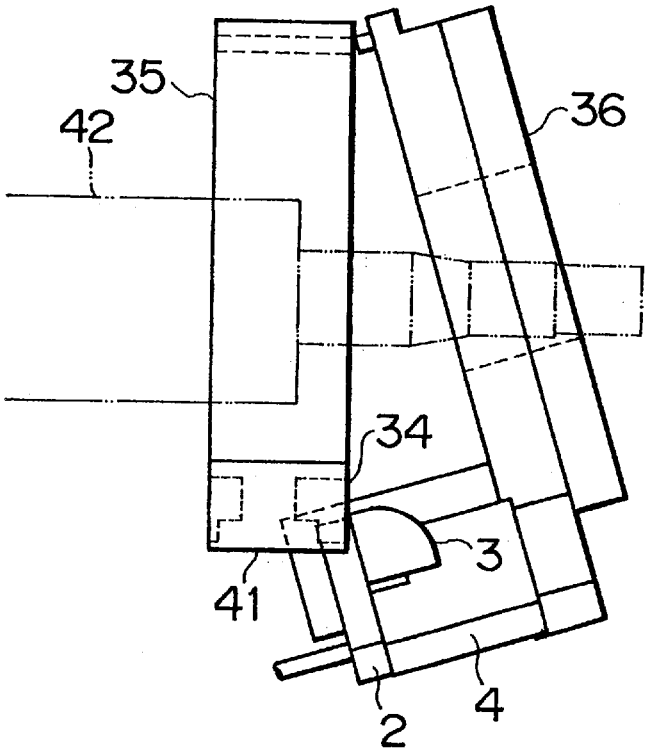
Figure 18:
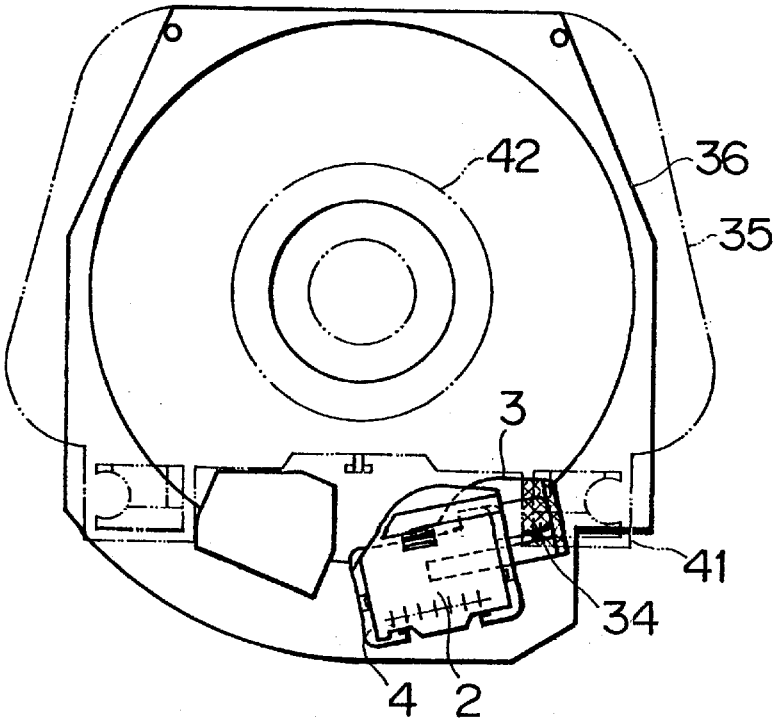
Figure 19A:
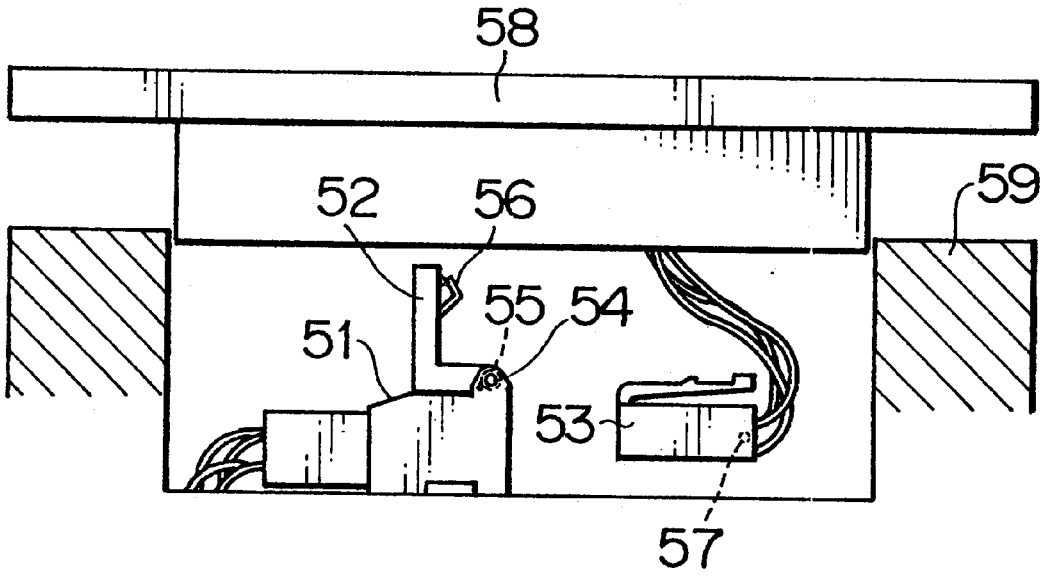
FIG. 19A PRIOR ART
FIGS. 19A ad 19B are partial sectional views of an example of a conventional connector locking mechanism.
Figure 19B:
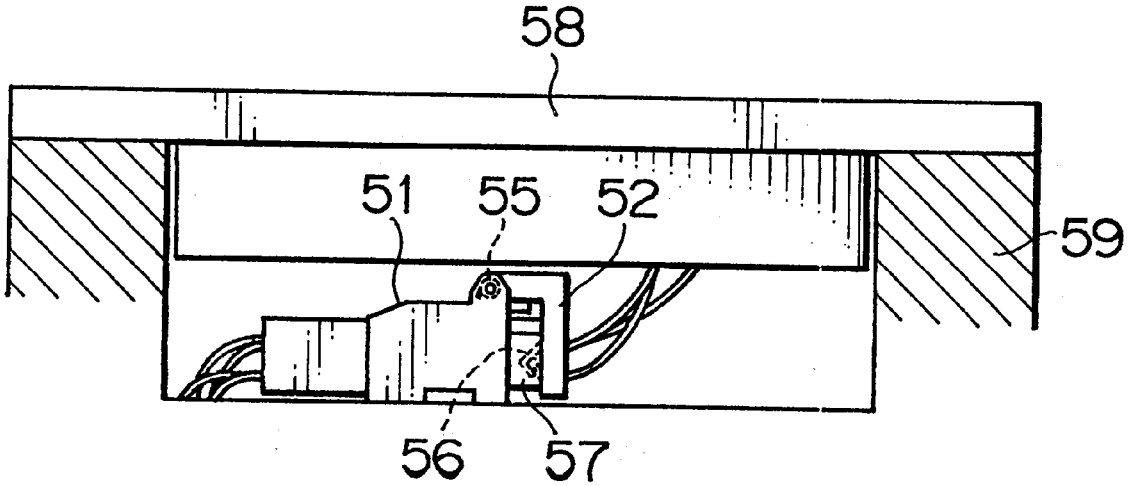
FIG. 19B PRIOR ART
Figure 20A:
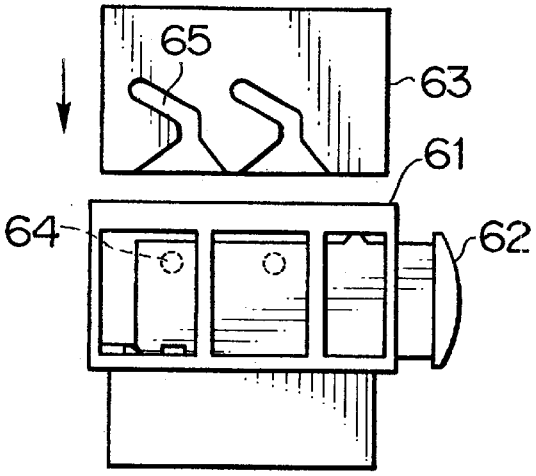
FIG. 20A PRIOR ART
FIGS. 20A to 20C are plan views of a conventional slide-lever-type connector.
Figure 20B:
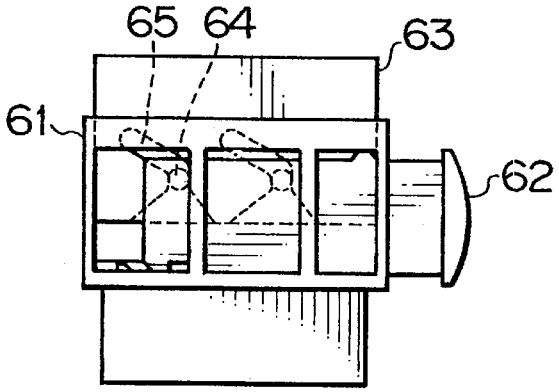
FIG. 20B PRIOR ART
Figure 20C:
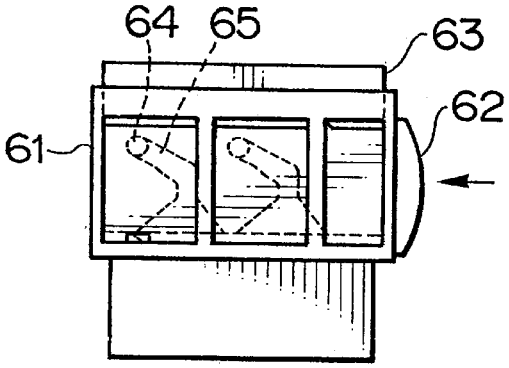
FIG. 20C PRIOR ART

FIGS. 16A and 16B show a situation where the slider 3 is not pushed in after the male connector 2 is engaged with the female connector 4 on the spiral 36. In this case, when the spiral 36 is attached to the combination switch 35, as shown in FIGS. 17 and 18, the slider 3 is brought into contact with the interfering portion 34, hindering the attachment of the spiral 36. Here, that the slider3 has not been pushed in, i.e., the unlocked state, can be detected. In FIG. 17, reference numeral 42 indicates a shaft of a steering wheel or the like, to which the combination switch 35 is attached.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A mechanism for detecting an unlocked state of connectors, comprising:

a first connector and a second connector to be engaged with each other;

a lock slider to be pushed in so as to lock the first and second connectors, the lock slider being slidably provided on the first connector in a direction perpendicular to a connector engagement direction;

a component including the first and second connectors;

a mating component to which the component is attached; and an interfering portion provided on the mating component, wherein the lock slider which is not in a fully inserted position after the first and second connectors have been fully engaged with each other, interferes with the interfering portion so as to detect an unlocked state of the first and second connectors.

2. The mechanism according to claim 1, wherein the lock slider not locking the first and second connectors abuts against the interfering portion in a direction perpendicular to the connector engagement direction so as to detect the unlocked state of the first and second connectors.

3. The mechanism according to claim 1, wherein a locking plate of the lock slider is provided with a front inclined portion and a rear flat portion in a direction perpendicular to the connector engagement direction, and the second connector is provided with a front inclined surface corresponding to the front inclined portion, a rear flat surface corresponding to the rear flat portion, and an insertion opening adjacent to the rear flat surface for accommodating the locking plate.

4. The mechanism according to claim 3, wherein when the rear flat portion is in complete contact with the rear flat surface after the lock slider is pushed in, length of a protruding portion of the lock slider is the same as a clearance between the second connector and the interfering portion.

5. The mechanism according to claim 4, wherein when the front inclined portion slides along the front inclined surface after the lock slider is pushed in so that terminals of the first and second connectors are separated from each other, length of the protruding portion of the lock slider is the same as the clearance.

6. A mechanism for detecting an unlocked state of connectors, comprising:

a first connector and a second connector to be engaged with each other;

a lock slider to be pushed in so as to lock the first and second connectors, the lock slider being slidably provided on the first connector in a direction perpendicular to a connector engagement direction;

a component including the first and second connectors;

a mating component to which the component is attached; and an interfering portion provided on the mating component, wherein the lock slider which is not in a fully inserted position after the first and second connectors have been fully engaged with each other, interferes with the interfering portion so as to detect an unlocked state of the first and second connectors wherein a locking plate of the lock slider is provided with a front inclined portion and a rear flat portion in a direction perpendicular to the connector engagement direction, wherein the second connector is provided with a front inclined surface corresponding to the front inclined portion, a rear flat surface corresponding to the rear flat portion, and an insertion opening adjacent to the rear flat surface for accommodating the locking plate, and wherein the lock slider is provided with a flexible stopper claw and the first connector is provided with a slip-off preventing protrusion to engage the stopper claw so as to prevent the lock slider from slipping off.

7. The mechanism according to any of claims 1 to 6, wherein an operation surface of the lock slider in a pushed-in state faces to a slide surface of the interfering portion.

* * * * *